US005678380A

United States Patent [19]

Azzar

[11] Patent Number: 5,678,380

[45] Date of Patent: Oct. 21, 1997

[54] ELASTOMERIC EDGE MOLDING WITH INTEGRALLY EXTRUDED DECOR LINE

[76] Inventor: James D. Azzar, 201 Cottage Rd. SE., Grand Rapids, Mich. 49507

[21] Appl. No.: 705,019

[22] Filed: Aug. 29, 1996

Related U.S. Application Data

[63] Continuation of Ser. No. 404,764, Mar. 15, 1995, abandoned.

[51] Int. Cl.[6] ..... E04C 2/38

[52] U.S. Cl. ..... 52/716.4; 52/716.5; 52/717.04; 52/718.06; 52/312; 312/140.4; 108/27

[58] Field of Search ..... 52/716.4, 716.7, 52/718.01, 718.03, 718.06, 717.03, 717.05, 716.5, 717.04, 716.6, 311.1, 312; 312/140.1, 140.3, 140.2, 140.4; 108/27; 4/631, 658, 619, 654, 656, 692

[56] References Cited

U.S. PATENT DOCUMENTS

| | | | |
|---|---|---|---|
| 2,030,730 | 2/1936 | Wilson . | |
| 2,509,037 | 5/1950 | Flicker . | |
| 2,531,967 | 11/1950 | Bishop | 52/716.5 X |
| 2,734,784 | 2/1956 | Wilson, Jr. . | |
| 2,763,346 | 9/1956 | Clingman | 52/312 X |
| 3,388,523 | 6/1968 | Evans | 52/716.5 |
| 3,842,564 | 10/1974 | Brown | 52/717.03 |
| 4,446,179 | 5/1984 | Waugh | 52/716.5 X |
| 4,530,192 | 7/1985 | Ginster | 52/716.5 X |
| 4,930,279 | 6/1990 | Bart et al. | 52/716.7 X |
| 5,344,205 | 9/1994 | Yada et al. | 52/716.5 X |

FOREIGN PATENT DOCUMENTS

| | | | |
|---|---|---|---|
| 1249271 | 11/1960 | France | 52/716.5 |

*Primary Examiner*—Lanna Mai

*Attorney, Agent, or Firm*—Sughrue, Mion, Zinn, Macpeak & Seas

[57] ABSTRACT

An elongated elastomeric T-molding formed of a body having opposed decorative outer and inner mounting surfaces defining spaced first and second edges and being adapted for flush mounting to an edge of an article of furniture by means of an integral flange projecting at right angles outwardly of the inner mounting surface of the body is frictionally fitted within an elongated groove within an edge of a planar article of furniture such that the inner mounting surface of the body lies flush with the edge of such planar article of furniture. The body has at least one decor line and preferably laterally spaced parallel decor lines integrally molded within the outer surface of the body and extending longitudinally along the body. The color of the elastomeric material of the decor line or lines contrasts with that of the body and is preferably of different durameter hardness. Preferably, the decor lines project outwardly from the decorative outer surface of the body to function as bumpers to prevent marring of the body decorative outer surface. The integrally molded decor lines, which may be commonly extruded with the body, may be of oval, circular, triangular or other cross-section.

8 Claims, 1 Drawing Sheet

ELASTOMERIC EDGE MOLDING WITH INTEGRALLY EXTRUDED DECOR LINE

This is a Continuation of application Ser. No. 08/404,764 filed Mar. 15, 1995 now abandoned.

FIELD OF THE INVENTION

This invention is directed to decorative edge moldings such as elastomeric T-moldings, normally including a perpendicular mounting flange on a rear face sized to and insertably mounted within a longitudinal groove routed into an edge of a desk or table top, and more particularly to such elongated elastomeric moldings having a plurality of decor lines integrally molded within the decorative outer surface of such molding.

BACKGROUND OF THE INVENTION

Articles of furniture such as tables and desks employ T-moldings as trim to the edges of such table and desk tops. U.S. Pat. Nos. 2,705,820 and 4,558,553 are typical of extruded elastomeric T-moldings having an arcuate decorate outer face and an inner face from which projects a single, right angle longitudinal mounting flange normally barbed and insertably fittable into a rectangular configured longitudinal groove within the edge of the desk top or table top.

In the general field of moldings, attempts have been made to cover or conceal a line of fastening devices employed to fixedly mount the molding to an underlying support member. U.S. Pat. No. 2,116,846 is directed to an elongated molding adapted to cover the joints of motor vehicle bodies and formed of metal in which a channel within the outer surface of the metal molding strip receives a pressed in soft metal cover strip such as an alloy of aluminum to cover the headed end of a series of fastening nails. U.S. Pat. No. 1,927,882 is directed to wooden moldings for decoration of building walls having a longitudinal groove within the outer surface for similarly receiving a series of spaced nails or like fasteners, whereupon a wood inlay in strip form sized to be received into and closely fit the channel is inserted therein to cover the heads of the nails or like fasteners.

U.S. Pat. No. 5,155,952 is directed to a T-shaped glazing profile strip with a barbed end for anchoring to a U-shaped spacer, with the glazing profile strip being of elastomeric material and overlying facing ends of glass panes or the like to vaulted outer faces of buildings. Such glazing profile strip may receive an insertable, different color, elastomeric filler profile strip inserted within a slot formed in the outer surface of the glazing profile strip.

SUMMARY OF THE INVENTION

The present invention is directed to an improved elongated, preferably extruded, elastomeric molding comprising a body preferably of T-shape including a decorative arcuate outer surface defining spaced first and second edges and having an opposite inner mounting surface from which projects at right angles a preferably barbed flange for fitting within a longitudinal groove within an edge of an article of furniture such as a desk top or table top, such that the spaced first and second edges of the body lie flush with the opposed surfaces of the table or desk top along the edge of the same. The invention is particularly directed to the inclusion of at least one integrally molded, exposed elastomeric decor line within the decorative outer surface of the body and extending longitudinally along the elongated elastomeric molding body. Preferably, the decor line or lines is of contrasting color and of different durameter to that of the body. Such decor lines may have a surface lying flush with the decorative outer surface of the body or projecting outwardly therefrom and may be of circular, oval or triangular cross-section. Where the spaced, parallel, longitudinally extending decor lines are of a softer durameter than that of the body, they function as bumpers to resist marring of the outer decorative surface of the elastomeric molding.

DESCRIPTION OF THE PREFERRED EMBODIMENTS

Figure 1:
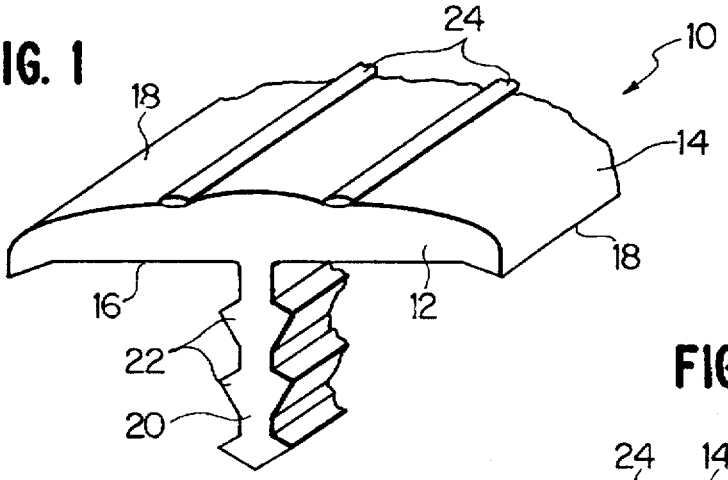
FIG. 1 is a perspective view of a portion of an elastomeric edge molding with integrally extruded decor lines forming a preferred embodiment of the invention.
Figure 2:
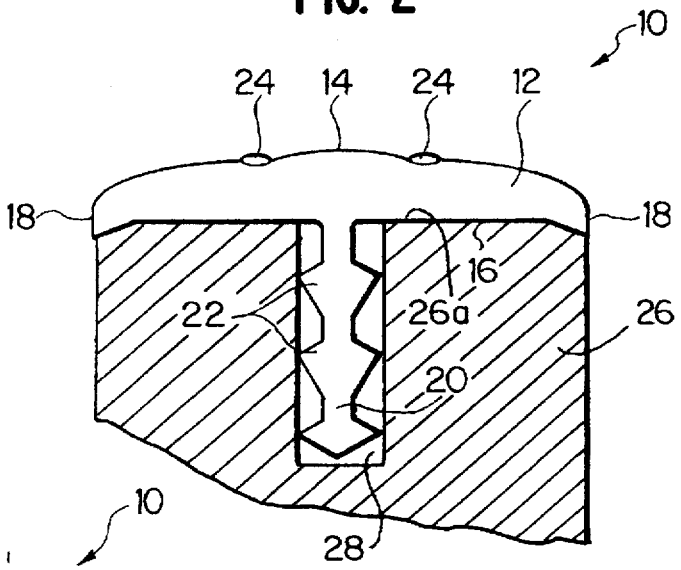
FIG. 2 is an end view of an elastomeric edge molding in which the spaced, parallel, integrally extruded decor lines are of circular cross-section.

Referring first to the embodiment of the invention in FIGS. 1 and 2, the elastomeric edge molding with integrally extruded decor lines is indicated generally at 10, is T-shaped in cross-section, is extruded of an elastomeric material such as polyvinyl chloride (PVC), although it may be formed of other types of elastomeric material. The molding 10 includes a body 12 defining an arcuate decorative upper surface 14 and a generally flat lower surface 16 forming laterally opposed edges 18. The width of the molding may be equal to the width of the edge of an article of furniture such as a desk top or table top (not shown). The method of mounting of the molding 10 to the exposed edge of a planar member of an article of furniture such as a desk top or table top may be appreciated by reference to U.S. Pat. Nos. 2,705,820 and 4,558,553, the content of which are incorporated herein by reference. In that respect, integrally molded width body 12 is a right angle flange 20 bearing several barbs 22 on opposite sides thereof and being of a lateral width so as to frictionally fit within a longitudinal slot or groove routed into the edge of the article of furniture such that the barbs 22 are deflected upon insertion to frictionally grip the inside surfaces of the groove and to prevent the removal of the flange 20, except by application of a large pulling force. When seated, the lower surface 16 of the body 12 is in flush contact with the exposed edge of the planar member of such article of furniture. Further, such extruded elastomeric T-moldings are of a flexible, resilient material, so that the molding can be bent to conform to any curvature in the plane of the table or desk top to which it is attached, as for instance to curving surfaces created by a rounded table top or desk top.

In the embodiment of FIGS. 1 and 2, the color of the commonly extruded elastomeric decor lines 24 is different from that of the elastomeric material forming the body 12, preferably with the two colors in high contrast to each other. In the illustrated embodiment, the extruded body 12 may be of relatively dark color such as black and that of the decor lines 24 of much lighter color such as white. Alternatively, the decor lines 24 may be red and the body 12 black. Where the body 12 is of a relatively light color, the decor lines 24 may be considerably darker. Further, as seen particularly in the cross-sectional view, FIG. 2, the decor lines 24, which are generally equally spaced from each other and equally distributed laterally about the periphery of the curved decorative upper surface 14 of body 12, are oval in configuration with the width of such lines being generally two to three times in excess of the height or thickness of the decor lines 24. Additionally, the decor lines 24 protrude outwardly from the decorative outer surface 14. The durameter hardness of the material making up the decor lines 24 may be less than that of the elastomeric material forming body 12. For example, the body may be of Shore C 96 durameter hardness and the decor line or lines may be of Shore C 90 durameter hardness. As such, the projecting portions of the decor lines 24 act as bumpers to resiliently absorb impact so as to prevent marring of the outer surfaces of both the body 12 and the decor lines 24. Alternatively, the protruding decor lines 24 may be of a harder material than the elastomeric material making up body 12 to resist deformation by impact, with the protrusions of those laterally spaced decor lines being such as to prevent an object striking the decorative outer surface 14 of body 12 from contacting the portion of that body intermediate of the side-by-side but spaced decor lines 24. As such, having the material making up the decor lines of a durameter hardness in excess of that of the body 12, the one or several decor lines may be significantly more effective as a bumper or bumpers than where the durameter hardness of the decor lines 24 are less than that of body 12.

Figure 3:
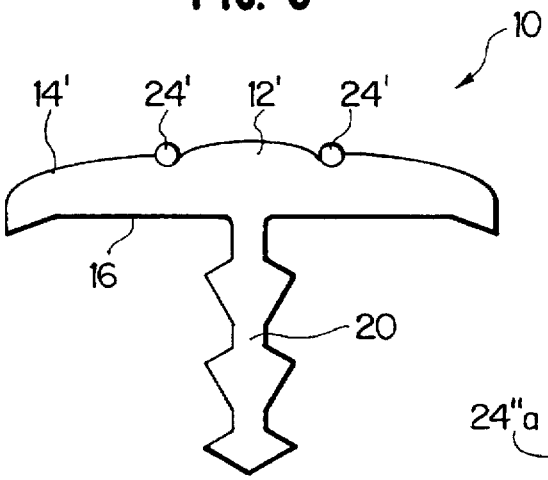
FIG. 3 is an end view of an elastomeric edge molding forming another embodiment of the invention.
Figure 4:
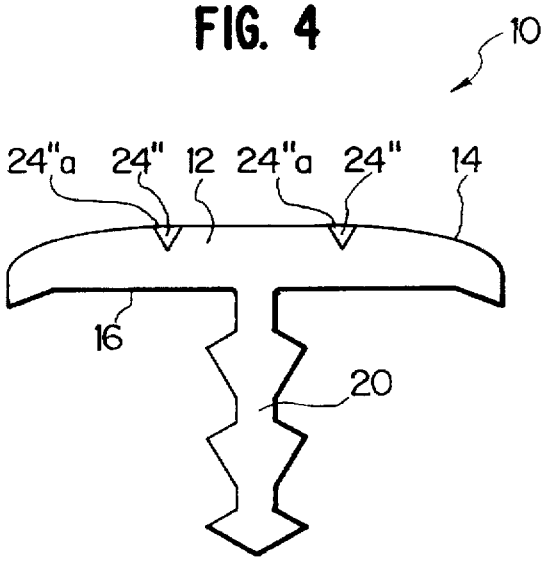
FIG. 4 is an end view of an elastomeric edge molding with integrally extruded decorative lines of triangular cross-section, with the outer surfaces thereof flush with the decorative outer surface of the elastomeric T-molding and forming yet another embodiment of the invention.

FIGS. 3 and 4 illustrate further embodiments of the invention, where like elements to those of FIGS. 1 and 2 are given like numerical designations. In FIG. 3, the elastomeric edge molding indicated generally at 10' is formed of a body 12' having the same configuration as that of the first embodiment and provided with a decorative upper surface 14 and a bottom surface 16, along with an integral flange 20 projecting downwardly from that bottom surface and integrally molded with body 12. The difference between the embodiment of FIG. 3 and that of FIGS. 1 and 2 lies in the cross-sectional configuration of the dual, laterally spaced decor lines 24'. They are circular in cross-section rather than oval, such that the decor lines project outwardly from the decorative upper surface 14 of the elastomeric T-molding 10' to a greater extent than the decor lines 24 of the first embodiment. In all other respects, the embodiment of FIG. 3 is identical to that of FIG. 1.

FIG. 4 illustrates a second alternative embodiment of the invention, with the elastomeric T-molding 10" having a body 12 which is configured and extrusion molded in the same manner as the first and second embodiments and utilizing a right angle, integrally molded flange 20 which projects downwardly from the flat lower surface 16 at right angles thereto in the manner of the first two embodiments. The difference in this embodiment lies both in terms of the durameter hardness of the body 12 and that of the dual decor lines 24" which are of generally triangular cross-section having outer surfaces 24" a which lie flush with the arcuate decorative outer surface 14 of body 12. Additionally, the durameter hardness of the decor lines 24" is greater than that of the body 12. Alternatively, the upper surfaces 24" a of the decor lines 24 may project some distance from the decorative outer surface 14 of the T-molding body 12. Further, the triangular shaped decor lines 24" may be commonly extruded such that the apexes of the triangular shaped decor lines face outwardly rather than inwardly within the extruded body 12, and indeed where those apexes project outwardly from the decorative outer surface 14 so as to form triangular projections raised from the decorative outer surface 14 of body 12. Finally, unlike the embodiments of the invention of FIGS. 1, 2 and 3, the body 12 may be formed of a material which is lighter than in color than the elastomeric material making up the decor lines 24, 24' and 24", respectively.

While the invention has been shown in the form of multiple embodiments, it should be understood that various changes in material content, durameter hardness and configuration may be made to the bodies and the decor lines of the respective elastomeric T-moldings without departing from the spirit of the invention as set forth in the claims appended hereto.

What is claimed is:

1. A unitary extruded elongated elastomeric T-molding comprising:

a body including opposed decorative outer and inner mounting surfaces defining spaced first and second edges, said inner mounting surface being adapted for flush mounting to an edge of a planar article of furniture with said spaced first and second edges of said body lying flush with opposed surfaces of said planar article of furniture, along said edge of said article of furniture, a mounting flange integrally molded with said body and extending at right angles from said inner mounting surface and adapted to frictionally engage a groove located in said edge of said planar article of furniture and being of a width sized to said groove to effect fixed coupling thereto, and at least one partially exposed, integrally molded elastomeric decor line within the decorative outer surface of said body and extending longitudinally along said body and being of a contrasting color to that of said body.

2. The elongated elastomeric T-molding as claimed in claim 1, wherein said at least one exposed elastomeric decor line is of a different hardness durameter from that of said body.

3. The elongated elastomeric T-molding as claimed in claim 2, wherein the hardness durameter of the decor line is softer than that of said body.

4. The elongated elastomeric T-molding as claimed in claim 1, wherein said at least one integrally molded elastomeric decor line projects outwardly from the decorative outer surface of said body.

5. The elongated elastomeric T-molding as claimed in claim 1, wherein the exposed surface of said at least one integrally molded elastomeric decor line lies flush with the decorative outer surface of said body.

6. The elongated elastomeric T-molding as claimed in claim 1, wherein said at least one integrally molded, exposed elastomeric decor line is of a different hardness durameter from that of said body, projects outwardly from the decorative outer surface of said body, and is of circular cross-section.

7. The elongated elastomeric T-molding as claimed in claim 1, wherein said at least one integrally molded, exposed elastomeric decor line is of a different hardness durameter from that of said body, projects outwardly from the decorative outer surface of said body, and is of oval cross-section.

8. The elongated elastomeric T-molding as claimed in claim 1, wherein said at least one integrally molded, exposed elastomeric decor line is of a different hardness durameter from that of said body, has an outer surface which lies flush with the decorative outer surface of said body, and is of generally triangular cross-section.

* * * * *